US005417764A

United States Patent [19]

Groult et al.

[11] Patent Number: 5,417,764

[45] Date of Patent: May 23, 1995

[54] METHOD AND DEVICE FOR SIZING A SHAPED ELEMENT

[75] Inventors: Pierre Groult, deceased, late of Etrechy, France, by Josette Groult, Therese Groult, Maria-Santa Groult, Vanina Groult, Henri Groult, Barthelemy Groult, heirs; Michel Huvey, Bougival, France

[73] Assignee: Institut Francais du Petrole, France

[21] Appl. No.: 214,843

[22] Filed: Mar. 18, 1994

Related U.S. Application Data

[60] Division of Ser. No. 937,154, Aug. 31, 1992, Pat. No. 5,350,602, which is a continuation of Ser. No. 201,447, Jun. 2, 1988, abandoned.

[30] Foreign Application Priority Data

Jun. 2, 1987 [FR] France ..... 87 07724

[51] Int. Cl.[6] ..... B05C 7/00

[52] U.S. Cl. ..... 118/249; 118/258; 118/261

[58] Field of Search ..... 118/249, 246, 258, 261; 427/428, 207.1, 208.2, 208.4

[56] References Cited

U.S. PATENT DOCUMENTS

| | | | |
|---|---|---|---|
| 3,303,814 | 2/1967 | Nitchie | 118/249 |
| 3,789,795 | 2/1974 | Brandenburg | 118/249 |
| 3,830,199 | 8/1974 | Saito et al. | 427/428 |
| 4,046,931 | 9/1977 | Innes et al. | 118/249 |
| 4,241,123 | 12/1980 | Shih | 428/105 |
| 4,594,962 | 6/1986 | Focke | 118/249 |
| 4,741,929 | 5/1988 | Kossuth | 118/262 |
| 4,766,841 | 8/1988 | Brown et al. | 118/269 |

FOREIGN PATENT DOCUMENTS

| | | | |
|---|---|---|---|
| 624114 | 2/1963 | France | 427/428 |
| 2312356 | 12/1976 | France . | |

*Primary Examiner*—W. Gary Jones
*Assistant Examiner*—Laura E. Edwards
*Attorney, Agent, or Firm*—Antonelli, Terry, Stout & Kraus

[57] ABSTRACT

An apparatus for the sizing of a shaped extended element having a longitudinal axis and including lateral surfaces extending substantially parallel to the axis. The apparatus includes a wheel rotatable about an axis. The wheel includes at least one planar ring-shaped surface extending perpendicular to the axis of the wheel and centered on the surface. The ring-shaped surface cooperates with the lateral surface of the shaped elongated element during a displacement of the wheel relative to the element along an axis parallel to the longitudinal axis of the element. A coating device is adapted to deposit, at least on the outer circumference of the wheel a sufficient amount of glue for allowing a sizing of the lateral surface of the shaped element.

6 Claims, 1 Drawing Sheet

METHOD AND DEVICE FOR SIZING A SHAPED ELEMENT

CROSS-REFERENCE TO RELATED APPLICATION

This application is a divisional of Ser. No. 07/937,154, filed Aug. 31, 1992, which issued as U.S. Pat. No. 5,350,602 on Sep. 27, 1994, which is a Continuation of Ser. No. 07/201,447, filed Jun. 2, 1988, now abandoned.

BACKGROUND OF THE INVENTION

This invention concerns a device for sizing extended cross-sectionally shaped or profiled elements, profiles or bars comprising a plane surface along longitudinal axis of the element.

The invention is particularly well adapted to the groove moulds used in the production of arc-shaped bars made of composite materials constituting flexible hollow shafts.

A process and apparatus for producing reinforced cross-linkable shaped section bars are described, for example, in the French patent FR-2.312.356, wherein a sectional groove mould corresponding to the section of the profile to be obtained is used, with reinforcement elements impregnated with cross-linkable resin rolled up onto a mandrel in a groove mould. Then, the cross-linkable material is cross-linked before separating the reinforced arc-shaped bar from the mandrel. In some applications of this process, the groove mould is not separated from the bar obtained and it is even desirable that both be properly linked.

SUMMARY OF THE INVENTION

The aim of this invention resides in providing a process and apparatus for sizing the internal walls of the groove mould, especially the lateral walls.

The invention provides an apparatus for sizing a shaped extended element having a longitudinal axis, with the element comprising at least one lateral surface.

According to advantageous features of the present invention, the apparatus comprises a wheel having an axis, with the lateral surface being roughly parallel to the longitudinal axis, at least locally near to the wheel, and with the wheel being driven by a rotation movement and comprising at least one ring-shaped surface centered on the wheel axis. The ring-shaped surface is adapted to cooperate with the lateral surface of the extended element during a displacement of the wheel relatively to the extended element along an axis parallel to the longitudinal axis of the element. The apparatus also comprises coating means adapted to deposit, at least on an outer circumference of the ring-shaped surface, a sufficient amount of glue allowing for sizing of the lateral surface of the extended element.

When the extended element also includes a groove bottom surface different from a shaped section lateral surface along the axis of the extended element, such as the bottom surface of a groove or even a surface roughly perpendicular to the lateral surface, the wheel could include a circumferential surface adapted to cooperate with the surface of the groove bottom. The coating means could be adapted to deposit on the circumferential surface of the wheel a sufficient quantity of glue to allow for sizing of the groove bottom surface.

The groove bottom surface could be roughly inscribed on a cone and possibly on a cylinder whose axis is included inside a plane perpendicular to the longitudinal axis, and the circumferential surface of the wheel may be conical.

The groove bottom surface could be roughly perpendicular to the lateral surface and the circumferential surface of the wheel could be roughly perpendicular to the ring-shaped surface.

The wheel could include an antiadhesive coating on the ring shaped surface and/or circumferential surface of the wheel adapted to respectively cooperate with the lateral and/or groove bottom surfaces of the extended element.

The extended element could be applied against the said wheel by at least one press roller or press-cylinder roller.

The coating means could include two mixing rollers between which is disposed the glue, with at least one of the rollers being coated with glue on one part of its outer surface, the wheel being in contact with the said roller coated with glue.

The element could include several lateral surfaces parallel to each other and the wheel could include as many lateral ring-shaped surfaces adapted to cooperate with the lateral surfaces of the extended element as are needed to size them.

At least one of the lateral surfaces of the extended element could be planar and at least one of the ring-shaped surfaces, adapted to cooperate with the lateral surfaces of the element, could be planar and be perpendicular to the wheel axis.

The invention also provides a process for sizing a shaped extended element having a longitudinal axis and comprising at least one lateral surface parallel to the longitudinal axis. This process comprising the steps of providing a wheel having an axis in at least one lateral ring-shaped surface substantially or roughly perpendicular to the axis of the wheel and centered on the axis, with the ring-shaped surface having an outer circumference, and with the wheel being rotatably driven. The extended or elongated element is moved relative to the wheel along an axis parallel to the axis longitudinal to the extended or elongated element, and the lateral surface of the extended or elongated element is made to cooperate with the lateral ring-shaped surface of the wheel. At least the outer circumference of the wheel is coated with a glue by a suitable coating means.

The invention also provides four an apparatus for sizing an extended element having a longitudinal axis and a groove bottom surface needing to be sized.

The apparatus includes a wheel and coating means, with the wheel having a circumferential surface osculating from a groove bottom surface, and with the coating means including two mixing rollers adapted to produce a glue film. One part of the glue film is transferred by the circumferential surface of the wheel onto the groove bottom surface by the contact of the wheel onto one of the two mixing rollers.

BRIEF DESCRIPTION OF THE DRAWINGS

The above and other objects, features, and advantages of the present invention will become more apparent from the following description when taken in connection with the accompanying drawings which show, for the purpose of illustration only, one embodiment in accordance with the present invention, and wherein.

DETAILED DESCRIPTION

Figure 1:
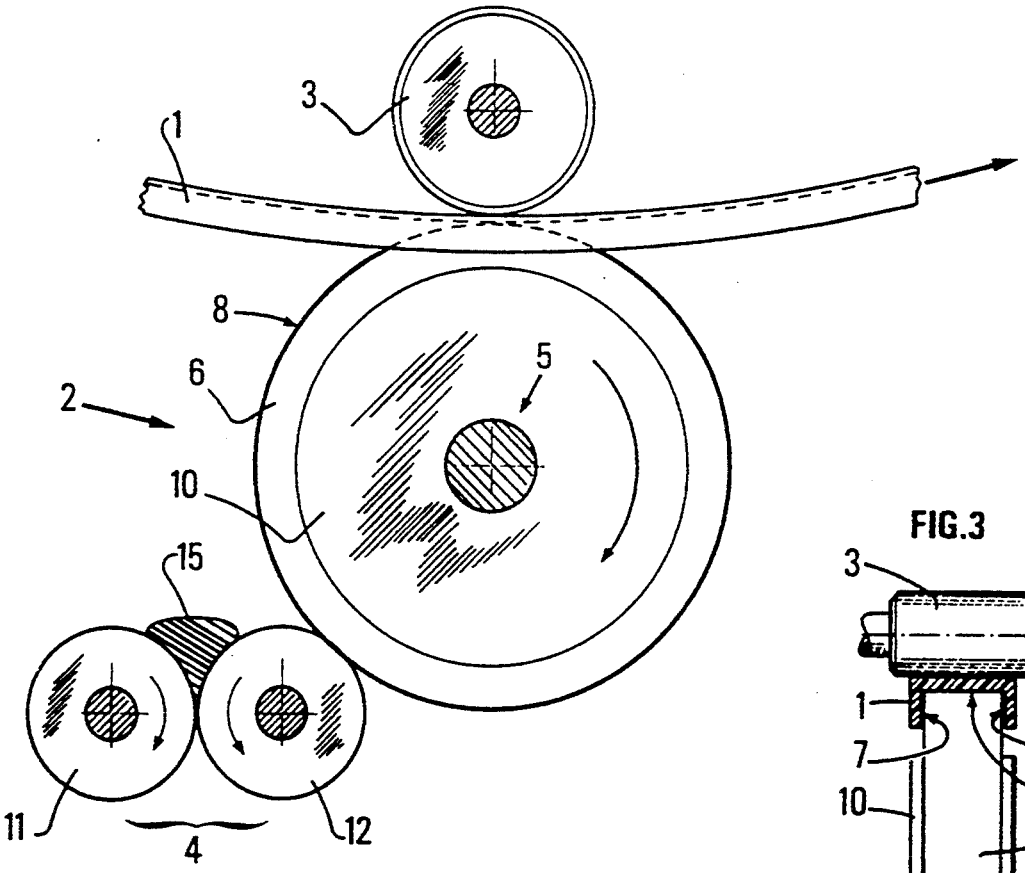
FIG. 1 is a front view, on an enlarged scale, of a portion of the sizing apparatus constructed in accordance with the present invention.

Referring now to the drawings wherein like reference numerals are used throughout the various views to designate like parts and, more particularly, to FIG. 1, according to this figure, a shaped flexible extended or elongated element 1 to be sized is penetrated by a sizing wheel generally designated by the reference numeral 2 and maintained on the sizing wheel 2 by a press-cylinder roller 3. The sizing wheel 2 and the press cylinder roller 3 comprise a means for positioning the elongated element to be sized from the mixing rollers 11 and 12 while contacting the ring-shaped surfaces 6. The sizing wheel 2 is driven by a continuous rotating movement around an axis generally designated by the reference numeral 5 by contact with a coating means generally designated by the reference numeral 4; whereas, the extended or elongated element 1 is driven by a directional displacement corresponding approximately or roughly to that of the tangential speed of a contact between the sizing wheel 2 and the extended or elongated element 1.

Figure 3:
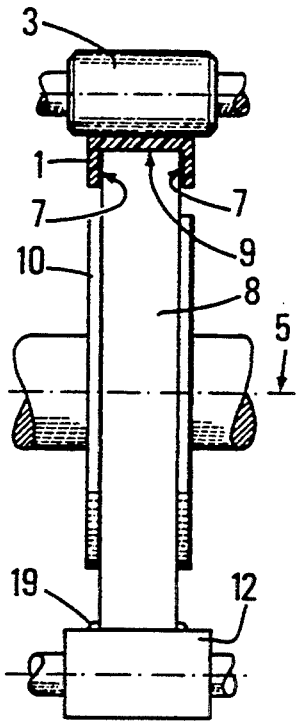
FIG. 3 is a side-face view of a glue-spreading or sizing wheel of the sizing apparatus of the present invention.

The sizing wheel 2 comprises two plane lateral annular or ring shaped surfaces 6 which are perpendicular to the axis 5 of the sizing wheel 2 or nearly so. A portion of these ring-shaped surfaces 6 cooperates with plane lateral surfaces generally designated by the reference numeral 7 (FIG. 3) of the extended or elongated element 1, with the plane lateral surfaces 7 extending along the longitudinal axis of the extended or elongated element 1.

These ring-shaped surfaces 6 are placed on both sides of the sizing wheel 2 and the plane lateral surfaces 7 of flexible extended on elongated element 1 are placed opposite the ring-shaped surfaces 6.

The outer surface of the sizing wheel 2, or the circumferential surface generally designated by the reference numeral 8, is adapted to cooperate with the shaped extended element 1 along a groove bottom surface generally designated by the reference numeral 9 disposed perpendicular to the two plane lateral surfaces 7 and forming with the plane lateral surfaces 7 the internal walls of a U-shaped groove of the extended or elongated element 1.

The sizing wheel 2 comprises on its lateral walls two end shields designed to maintain and/or guide the sizing wheel 2 so as to, in particular, ensure proper cooperation of the sizing wheel 2 with the extended or elongated element 1, correct drive, and sizing at the level of the coating means 4.

Figure 2:
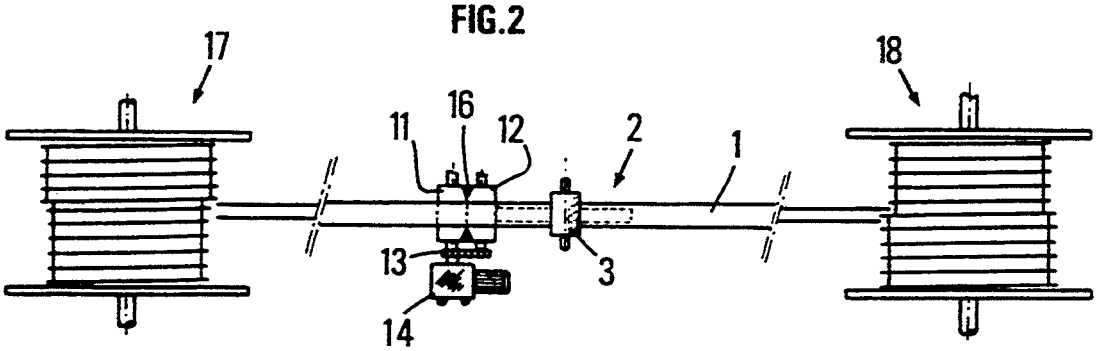
FIG. 2 is a top view of a sizing apparatus constructed in accordance with the present invention.

The coating means 4 include two mixing rollers 11, 12 rotatably synchronized by a train of gears 13 (FIG. 2) and driven by a reducer and motor unit 14 (FIG. 2)

Above and between the mixing rollers 11 and 12, turning in the opposite direction and at the same speed, a glue mass 15 is disposed intended for sizing.

This glue mass 15, which may be liquid, pasty or indeed solid, is kept inside the inter-rollers upper space by two centering tools or glue mass limit devices 16 (FIG. 2).

The flexible extended or elongated element is delivered from a coil generally designated by the reference numeral 17 (FIG. 2), routed towards the sizing wheel 2, then when once coated is discharged to a receiving coil generally designated by the reference numeral 18.

The process for sizing the plane lateral surfaces 7 of the groove bottom surface 9 of the section is carried out by placing the glue mass 15 between the mixing rollers 11 and 12 with the glue mass 15 being rolled by the mixing rollers 11, 12 into a very fine layer which adheres to the mixing rollers 11, 12. One part of the fine glue layer is then recovered by the osculating surface 8 of the sizing wheel 2, possibly via slight contact pressure being exerted between the sizing wheel 2 and the mixing roller 12.

A peripheral cylindrical glue cord 19 (FIG. 3) is provided on the outer circumferences of the ring-shaped surfaces 6, with enough glue to coat the lateral surfaces 7 of the flexible shaped extended or elongated element 1. By rotating the sizing wheel 2, the peripheral cylindrical glue cord 19 is then routed towards the plane lateral surfaces 7 where it spreads out due to the ring-shaped surfaces 6 and the combined movements of the wheel 2 and the element 1.

The size of the peripheral cylindrical glue cord 19 results in particular from the spacing combination of the mixing rollers 11, 12 defining the thickness of the film of glue on the rollers, the type and geometry of the sizing wheel 2 and contact pressure with the mixing roller 12 of the mixing rollers 11, 12.

The size of the peripheral cylindrical glue cord 19, like the different relative speeds of the moving elements and their geometry, determines the thickness of the film of glue on the lateral surfaces 7 and groove bottom 9 of the flexible shaped extended or elongated element 1.

Without involving any restriction concerning the type of elements used to implement the process of the invention, it is possible to use steel or aluminium mixing rollers 11, 12, Teflon centering tools or gum-limit devices 16, a Teflon, neoprene or silicon rubber sizing wheel 2 reinforced by metal wheel disks 10 to size a polyamide shaped element 11 (generally designed by the Rilsan manufacturing brand) with, for example, the epoxide glue SCOTCH-WELD 2216 B/A which is a brand registered by the Minesota Mining and Manufacturing Company in accordance with the proportions proposed by the manufacturer.

For example, a cord with a diameter of 1/10th to 1/100th of a millimeter enables thicknesses to be obtained with sufficient glue over a width of one of the plane lateral surfaces 7 of the extended or elongated element 1 of about one centimeter.

When the groove bottom surface 9 is not planar, it is possible, with a material of an adapted sizing wheel, to design the circumferential surface 8 with an proper form so that this surface can cooperate firstly with the greater bottom surface 9 and secondly with the outer surface of the mixing roller 12 with which it comes into contact. Thus, the association of the choice of hardness of the wheel and the form of the circumferential surface 9 enables the surface 8 to fit both the sizing cylindrical revolution surface of the roller 12 and the non-cylindrical groove bottom surface 8.

In the embodiment described above, the flexible extended or elongated element 1 comprises two lateral plane surfaces 7 perpendicular to the groove bottom surface 9 and the sizing wheel 2 includes two plane ring-shaped surfaces 6. It is also within the scope of this invention to use it when at least one of the plane lateral surfaces 7 is not perpendicular to the axis of the sizing wheel 2 and when it could cooperate at least with one outer circumference of a ring-shaped surface 6, either without deformation of the sizing wheel 2 and/or the flexible extended or elongated element 1, or with deformation of one and/or the other, especially when they are elastic. Thus, the plane lateral surfaces 7 of the extended or elongated element 1 might tend to close or open the extended or elongated element 1.

Thus, the lateral surfaces of the element might tend to close the element or open it.

Similarly, the ring-shaped surface(s) 6 need not necessarily be planar and could be truncated. The top of the cone on which rests the ring-shaped surface 6, which is the axis 5 of the sizing wheel 2, could be either on one *side, or on the other of the plane in which occurs the outer contour of the ring-shaped surface 6.

The material of the sizing wheel 2 could enable the ring-shaped surface 6 to be adapted to the lateral surface 7 by deforming the sizing wheel 2 and/or the profiled or shaped extended or elongated element 1, especially as regards the contact of the sizing wheel 2 with the extended or elongated element 1.

The ring-shaped surface 6 could be composed of sections of cones and could also coat varied forms allowing the ring-shaped surface 6 to be adapted to the lateral surfaces of the shaped or profile of the extended or elongated element 1.

For example, when the profile or shape of the extended or elongated element 1 comprises at least one lateral surface 7 perpendicular to the axis 5 and when the sizing wheel 2 includes a hollow conical ring-shaped surface 6 (as opposed to relief), the coating of the plane lateral surface 7 shall be effected by the outer contour of the ring-shaped surface 6.

Generally speaking, in order to carry out proper sizing of the plane lateral surfaces 7 of profile or shape of the elongated or extended element 1, it is essential that the outer circumferences of the ring-shaped surfaces 6 of the sizing wheel 2 are quite close to, or indeed even touch via a suitable clamping, the plane lateral surfaces 7 to be sized.

According to the same process, it is possible to size as many lateral surfaces 7 as desired, this possibly being the case for a shaped or profiled elongated or extended element 1 including several parallel grooves.

Also, it is possible, by preventing the circumference of the ring-shaped surface 6 being fed by a glue cord 19, to avoid carrying out sizing on a lateral surface of the elongated element.

It is possible to use scrapers disposed on the mixing rollers 11, 12 in order to concentrate or disperse the glue near to the circumferential surface of the sizing wheel 2 peripheral cylindrical glue, so that the cord 19 has the correct dimensions. Moreover, a coating means may be provided which does not employ mixing rollers.

It is possible to size only the groove bottom surface 9 of the shaped or profile extended or elongated element 1 and use the mixing rollers 11,12 for this purpose, and it is also possible to press the profile or shaped extended or elongated element 1 against the sizing wheel 2 by using several pressing rollers.

The mixing rollers 11, 12 with coating means 4 need not be synchronized in rotation relative to each other and/or with the sizing wheel 2, or be synchronized at different speeds in order to obtain a friction 25 force when such a force has beneficial consequences.

Especially, at the level of contact of the mixing roller 12 with the sizing wheel 2, it is possible to tranversally guide the shaped or profiled elongated or extended element 1 with the aid of the rollers leaning against the lateral faces of the shaped or profiled extended or elongated element 1.

The invention is more particularly applicable to the groove mould sizing used in the production of composite armors for flexible extended bodies.

What is claimed is:

1. An apparatus for sizing a shaped elongated element having a longitudinal axis, a bottom surface and lateral surfaces disposed substantially perpendicular to the bottom surface, the apparatus comprising:

a wheel having an axis;

at least one ring-shaped member including an outer circumferential surface and two lateral surface portions extending around a periphery of said wheel, said lateral surfaces of said shaped elongated element being substantially parallel to said longitudinal axis thereof at least locally of said wheel, said lateral surface portions of said at least one ring-shaped member cooperating with the respective lateral surfaces of said shaped elongated element and with said outer circumferential surface cooperating with said bottom surface;

coating means for depositing at least on the outer circumferential surface of said at least one ring-shaped member a sufficient quantity of sizing for allowing a sizing of said bottom surface and lateral surface portions of the shaped elongated element, said coating means comprising at least two mixing rollers between which a sizing is disposed;

means for positioning the shaped elongated element so that said shaped elongated element is spaced from said at least two mixing rollers and contacts said at least one ring-shaped member in a desired location, said means for positioning comprising said wheel, and wherein at least one of said at least two mixing rollers is coated with sizing on one part of an outer surface thereof, and said wheel is in contact with said at least one mixing roller coated with the sizing, whereby the sizing is transferred from said at least one mixing roller to said wheel and from said wheel to said bottom surface and said lateral surfaces of the shaped elongated element.

2. An apparatus in accordance with claim 1 wherein said means for positioning further comprises:

a roller having an axis parallel to said axis of said wheel.

3. An apparatus for sizing a shaped elongated element having a longitudinal axis, a bottom surface and two lateral surfaces disposed substantially perpendicular to the bottom surface, the apparatus comprising:

a wheel having an axis;

at least one ring-shaped member including an outer circumferential surface and two lateral surface portions extending around a periphery of said wheel, said lateral surfaces of said shaped elongated element being substantially parallel to said longitudinal axis thereof at least locally of said wheel, said lateral surface portions of said at least one ring-shaped member respectively cooperating with said lateral surfaces of said shaped elongated element; and coating means for depositing at least on the outer circumferential surface of said at least one ring-shaped member a sufficient quantity of sizing for allowing a sizing of said lateral surfaces of the shaped elongated element, said coating means comprising at least two mixing rollers between which a sizing is disposed, said at least two mixing rollers being spaced from and not in contact with said shaped elongated element, at least one of said at least two mixing rollers is coated with sizing on one part of an outer surface thereof, and said wheel is in contact with said at least one mixing roller coated with the sizing, whereby the sizing is transferred from said at least one mixing roller to said wheel and from said wheel to said bottom surface and said lateral surfaces of the shaped elongated element; and wherein said wheel includes an anti-adhesive coating on at least one of the lateral surface portions of the ring-shaped member and the circumferential surface portion of the wheel.

4. An apparatus according to claim 3, wherein at least one pressed roller urges said shaped elongated element against said wheel.

5. An apparatus for sizing a profiled elongated element having a longitudinal axis, a groove bottom surface, and lateral surfaces disposed substantially perpendicular to the bottom surface, the apparatus comprising:

a wheel for applying sizing to said profiled elongated element, said wheel including a circumferential surface and two lateral surface portions respectively cooperable with said groove bottom surface and the respective lateral surfaces of the elongated element;

coating means including at least two mixing rollers for producing a sizing film; and means for positioning the profiled elongated element so that it is spaced from said at least two mixing rollers and not in contact with said profiled elongated element, said means for positioning comprising said wheel; and wherein one portion of the sizing film is transferred from one of said at least two mixing rollers to said circumferential surface of said wheel by a contact of said circumferential surface of said wheel with said one of said at least two mixing rollers and from said circumferential surface of said wheel onto said bottom surface of the profiled elongated element and from the two lateral surface portions to the respective lateral surfaces of the profiled elongated element.

6. An apparatus in accordance with claim 5 wherein said means for positioning further comprises:

a roller having an axis parallel to an axis of said wheel.

* * * * *